US011596228B1

(12) United States Patent
Pavlansky et al.

(10) Patent No.: US 11,596,228 B1
(45) Date of Patent: Mar. 7, 2023

(54) FURNITURE CORNER PROTECTOR

(71) Applicant: Hibco Plastics, Inc., Yadkinville, NC (US)

(72) Inventors: Mark Pavlansky, Yadkinville, NC (US); Keith Pavlansky, Yadkinville, NC (US)

(73) Assignee: Hibco Plastics, Inc., Yadkinville, NC (US)

( * ) Notice: Subject to any disclaimer, the term of this patent is extended or adjusted under 35 U.S.C. 154(b) by 0 days.

(21) Appl. No.: 17/161,942

(22) Filed: Jan. 29, 2021

Related U.S. Application Data

(60) Provisional application No. 62/969,296, filed on Feb. 3, 2020.

(51) Int. Cl.
*A47B 95/04* (2006.01)
*B65D 81/05* (2006.01)

(52) U.S. Cl.
CPC ..... *A47B 95/043* (2013.01); *B65D 81/053* (2013.01)

(58) Field of Classification Search
CPC .. B65D 81/053; B65D 81/054; B65D 81/055; B65D 81/056; B65D 81/057; B65D 81/058; A47B 95/043; A47B 2095/046
See application file for complete search history.

(56) References Cited

U.S. PATENT DOCUMENTS 2,633,252 A 3/1953 Friedman
2,955,863 A 10/1960 Olender
3,511,464 A * 5/1970 Doll ..... A47B 95/043 248/345.1
3,843,038 A * 10/1974 Sax ..... B65D 81/056 206/586
3,900,156 A * 8/1975 Clark, Jr. ..... B65D 5/5033 206/586
3,994,433 A * 11/1976 Jenkins ..... B65D 81/056 206/586
4,194,630 A * 3/1980 Kaiser ..... B65D 81/057 206/586
D260,590 S 9/1981 Hobson
4,529,091 A * 7/1985 Martin ..... B65D 81/056 206/453
4,817,902 A * 4/1989 Mason ..... A47B 95/043 52/287.1

(Continued)

FOREIGN PATENT DOCUMENTS

JP H0776371 A * 3/1995 ..... B65D 81/056

OTHER PUBLICATIONS

Physical Properties of Ethafoam (TM) 180 Polyethylene Foam, Nov. 4, 2018, http://www.qualityfoam.com/docs/ethafoam-180.pdf (Year: 2018).*

*Primary Examiner* — Jonathan Liu
*Assistant Examiner* — Guang H Guan
(74) *Attorney, Agent, or Firm* — MacCord Mason PLLC

(57) ABSTRACT

Corner protectors, including corner protectors for furniture corners, are shown and described. Corner protectors may include, in some examples, a body, a first end including a shoulder, a second end including a cutout, a first side, and a second side. A cutout may include an attachment projection and an attachment receptor. Corner protector sheets may stack for convenient storage, with individual corner protectors removable from the corner protector sheet and each taking on an expanded form to fit around a furniture corner.

15 Claims, 6 Drawing Sheets

(56) References Cited

U.S. PATENT DOCUMENTS

| | | | | | |
|---|---|---|---|---|---|
| 5,175,041 | A * | 12/1992 | Webb | B65D 65/44 | 206/586 |
| 5,511,667 | A * | 4/1996 | Carder | B65D 65/44 | 206/521 |
| 6,488,153 | B1 * | 12/2002 | Morris | B65D 81/056 | 206/523 |
| 6,722,502 | B1 * | 4/2004 | Newman | B65D 81/052 | 206/453 |

* cited by examiner

FURNITURE CORNER PROTECTOR

This application claims the benefit of provisional application No. 62/969,296, filed Feb. 3, 2020, which is incorporated herein by reference in its entirety.

FIELD OF THE TECHNOLOGY

The present disclosure relates generally to corner protectors, and more particularly to improved corner protectors for furniture.

BACKGROUND

Corners on furniture are often where the most damage occurs due to multiple impacts with sides of trucks, the ground, or other goods during shipment. Corners are one of the primary areas of concern when considering the protection of finished goods, and, often become costly damage points for manufactures and/or delivery companies. There is a challenge to ensure that furniture like sofas, tables, hutches, servers etc. will arrive in pristine condition at an end customers location, such as a home or office, and that the furniture looks just like it did in the furniture showroom, in pictures in a catalog, or on an online website.

When damaged goods arrive at a customer's location, they cost manufacturers hard dollars in warranty claims that are remedied through additional manufacturing repairs, and also additional shipping costs. When damaged goods arrive at a customer's location, they also result in soft dollar costs that materialize in the form of a damaged brand name and damaged reputation.

Some conventional methods to reduce or eliminate damage that occurs during shipment of furniture goods have been in the form of large and expensive thick plastic poly bags or bubble wrap, or with oversized corrugated boxes. Linear low-density poly bags, in some examples, require more labor to apply large amounts of clear tape required to seal the bags properly, and while damage is often reduced during shipments, the price paid to wrap the manufactured goods is prohibitive because of both labor and raw materials required. The use of excessive oversized corrugated boxes usually results in significantly less efficient shipping, excess environmental impact, and substantial additional finished goods expenses. Both of these types of wrappings to cover furniture, however, also over-protect large portions of the finished furniture that are not prone to damage, significantly raising costs by providing unnecessary wrapping and an inability to focus protection where it is most necessary. Such traditional wrappings may also be extremely time-intensive, not malleable, and/or increase labor costs for packagers. It is to these and other challenges the invention of the present disclosure is directed.

SUMMARY

In accordance with the present disclosure, corner protectors are provided for protection of furniture. This disclosure provides improved corner protector systems, devices, kits and methods that are convenient, efficient, economical, and durable.

In some embodiments a corner protector includes a body, a first end, a second end, a first side and a second side. The first end may include one or more shoulders. The second end may include one or more cutouts. The cutout may include an attachment projection. The cutout may include an attachment receptor.

The corner protector may include a first position and a second position. The first position may be a linear sheet position. The first position may be a flat sheet. The second position may be an assembled position. The second position may be a folded position. In the second position, the corner protector may take on a pyramidal shape. In some examples, the pyramidal shape may include four sides. The attachment projection may mate with the attachment receptor to secure the corner protector in the second position. In some examples, the body may be a flexible body. The body may be a stretchable body. The body may be a foam body. The foam body may be a polyolefin foam body.

The corner protector may include an adhesive on the body. The adhesive may be a strip of adhesive. An adhesive cover, for example, a contact release liner, may be included.

Conventional attempts to protect furniture, such as with shrink wrap or bags have failed to protect the furniture around the corners and lack the strength for suitable durability. Corrugated materials have been combined with shrink wrap. While this combination may somewhat limit damage with specific pieces of furniture that have consistent right angles in their corners, this combination doesn't provide a widely adaptable method of packaging protection for the overwhelming number of unique and individual furniture shapes and sizes that have become much more common over time in the lines developed and sold by competitive furniture manufacturers who are all trying to make products that stand out from each other and will draw the consumers attention because of their uniquely developed look and style. Such attempts do not allow targeted protection in a malleable and concise form, that cuts down on environmental waste, covering time, storage space needed, and cost.

The inventions of the present disclosure serve to control costs, provide multiple impact corner protection for finished goods, and ensure that furniture can be concisely protected even when there are unique angles on the corners, with targeted, concise coverage. Many furniture manufacturers produce multiple styles of furniture across numerous product lines, and the corner protector may be beneficial alone and/or in combination with using a stretch film in instances where a high degree of flexibility is required. Stretch film can be applied using mechanized equipment instead of hand labor, then the polyolefin corner protectors can be applied either on the stretch wrap or under a layer of the stretch wrap and can provide consistent and cost-effective multiple impact corner protection.

In some examples, a system for a corner protector may include a set of stackable linear sheets, wherein each sheet within the set of stackable linear sheets includes, a set of corner protectors arranged in a first position. Each corner protector of the set of corner protectors may include, a body, a first end including a shoulder, a second end including a cutout, a first side, and a second side. The cutout may include an attachment projection and an attachment receptor. In one example, this structure allows the corner protector sheets to be direct sent from its own source of manufacture to a furniture manufacturer. This allows for a reduction of shipment costs. The corner protector system may take on a flat sheet shaping, by way of example in a blank. Once shipped in the flat sheets to the furniture manufacturer, the corner protectors in the system may be separated and alternated into a multi-dimensional second position. The corner protectors are able to rapidly snap from the flat sheet first position into a multi-dimensional second position by way of, in some examples, a mechanical fastening method.

In some examples, the body may be a polyolefin foam. The body may have a relative flexibility, a compression set of around 25%, tensile stress of around 58 psi, an elongation of around 25.5%, and/or a tear resistance of 8.4 lb.cu.ft. These overlapping features create a unique corner protector that is able to stretch, and to more readily conform to a significant variation in angles and shapes of furniture corners produced by furniture manufacturers, while also being economical and durable. Impact protection is also achieved, with some examples including a compression strength of between about 3.0 psi to about 12.5 psi (ASTM D3575-93 Suffix D @ 25%/50%) variable with size differentiation. In some examples the corner protector may include a compression set of between 25%-28% (ASTM D3575-93 Suffix B). The flexibility and durability are often competing factors and the inventions of the present disclosure are an improvement over corrugated or rigid plastic which are both much more limited in one or more of these factors.

In certain instances, the corner protector may, in a second position, take on a folded shape. The folded shape may be a pyramid. This pyramidal shape provides more effective protection of the edges of the furniture. In some examples, the corner protector may include at least 7" sides, and in some cases at least 7.5" sides. The corner protector may also include at least a 3.75' inner height, and in some cases at least a 4" inner height. The pyramidal shape may be a four-sided pyramid including at least 7" to 7.5" sides at the four bases, with a tall height of at least 3.75" to 4". Conventional protectors of this size would take up around 89 cubic inches of shipping space, in comparison to Applicant's inventions where, by way of example, an entire corner protector sheet when shipped flat in a first position, would only consume about 36.125" cubic inches of shipping space. This is an increased shipping capacity over a conventional type protector where in a pallet 36×48" stacked 3" high will hold about 3,048 formed protectors, however, Applicant's flat to folded corner protector system in the same shipping container would hold 5,040, a 165% increase and improvement. This significant savings in freight costs is an important consideration that drives manufacturing cost of goods down for the furniture manufacturer.

Corner protectors may include a strip of adhesive that may be applied prior to arriving at a furniture manufacturer. A suitable adhesive may, by way of example, be a Jowatherm® 245.55 pressure sensitive hot melt adhesive and may include a cover. A suitable cover may, by way of example be a silicone release liner paper by Rayven, Inc. This combination is one that allows the corner protector to be held in place in a cost-effective manner, for example, when the assembled corner protector is placed on top of a layer of stretch wrap. With the adhesive layer, furniture manufacturers will have the flexibility to choose to adhere the corner protector onto a layer of stretch film that has been applied to the finished furniture then ship their finished goods, or they can choose to add another layer of stretch film depending on their quality specifications and depending on their internal material cost goals.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
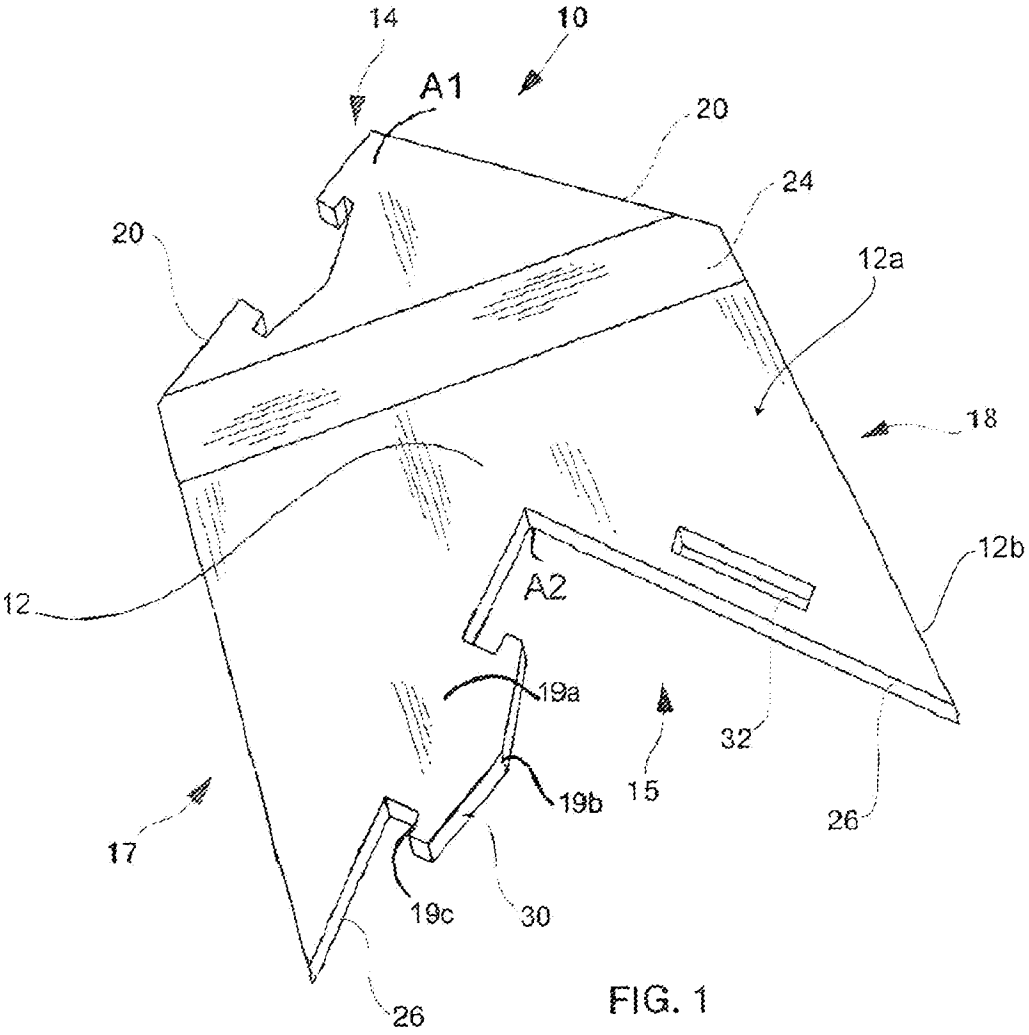
FIG. 1 is a front view of a corner protector according to an embodiment of the present disclosure in a first position.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Referring now to the drawings in general, it will be understood that the illustrations are for the purpose of describing embodiments of the disclosure and are not intended to limit the disclosure or any invention thereto. In one example, a corner protector 10 is shown embodied according to the present disclosure and may include a body 12, a first end 14, a second end 15, a first side 17 and a second side 18. The body 12 may include a first main surface 12*a* and a second main surface 12*b* opposite to the first main surface. The first end 14 may include one or more shoulder 20, by way of example, a first shoulder and a second shoulder. The first shoulder and the second shoulder may meet each other and form an angle A1 therebetween. The second end 15 may include one or more cutout 26. The cutout 26 may include an attachment projection 30. The cutout may include a first cutout side and a second cutout side. The first cutout side and the second cutout side meet each other and form an angle A2 therebetween. The body may include an attachment receptor 32 that is spaced apart from the second cutout side and is also spaced apart from the second side.

Figure 2:
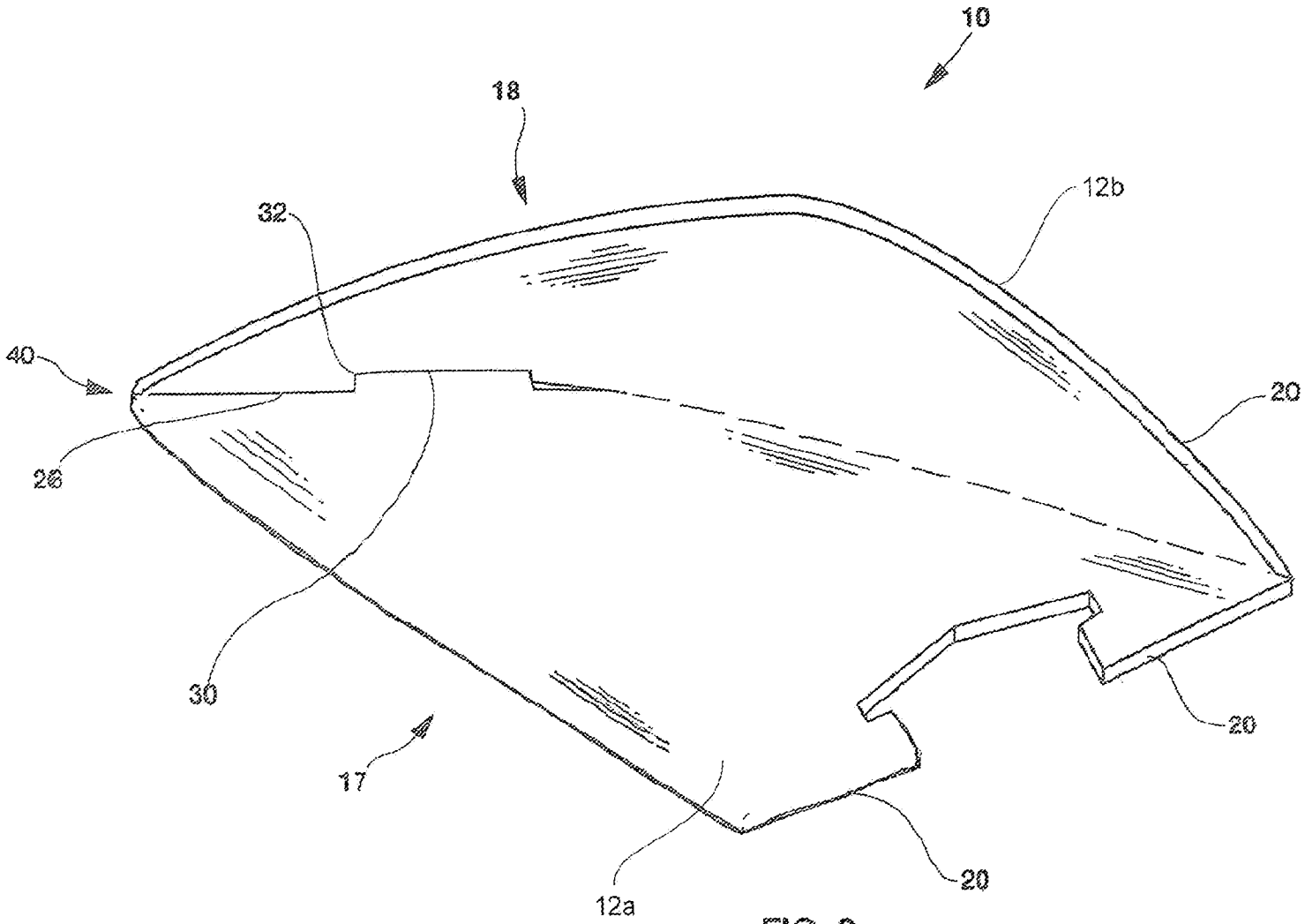
FIG. 2 is a front view of a corner protector according an embodiment of the present disclosure in a second position.
Figure 3:
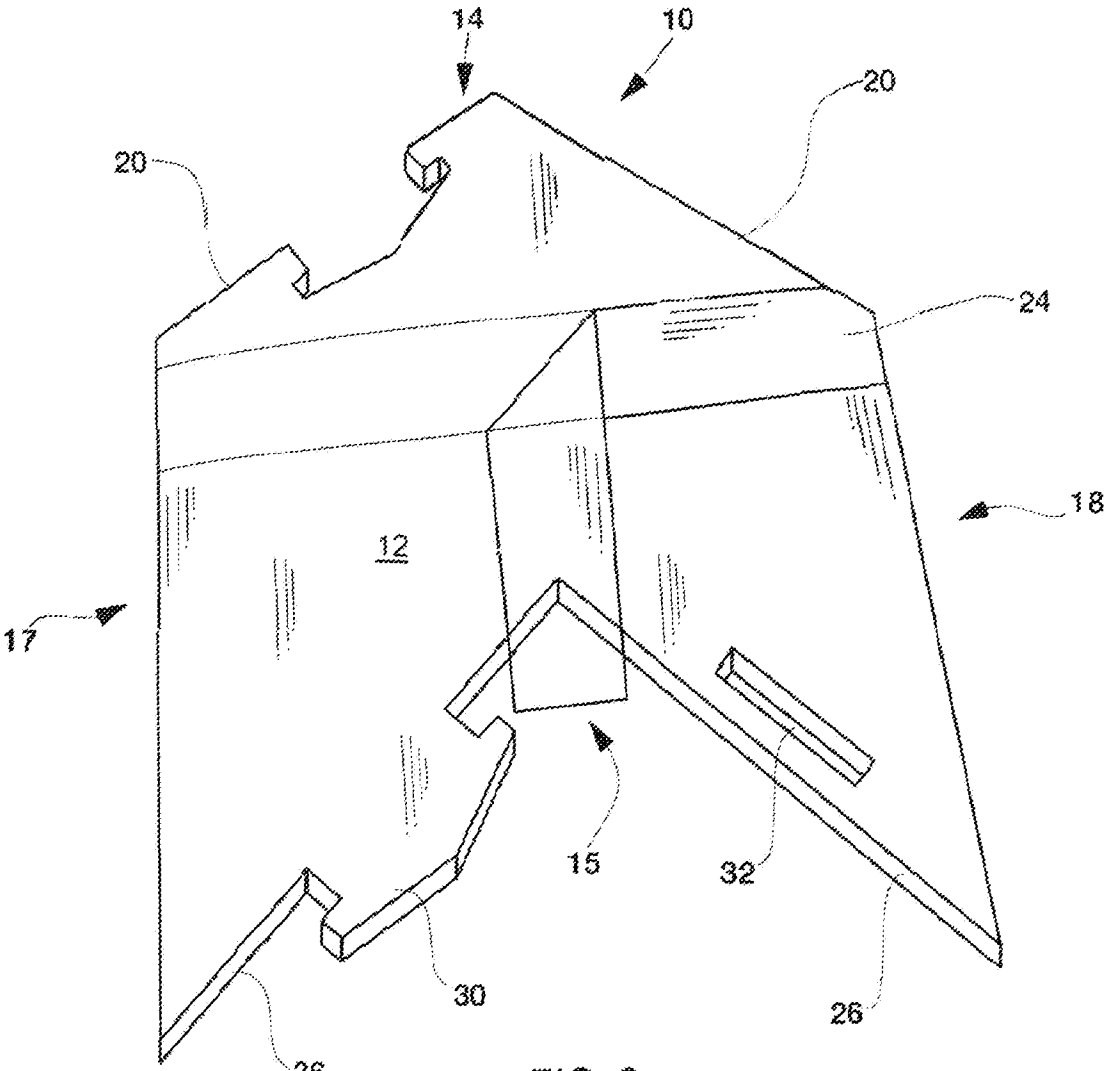
FIG. 3 is an alternative front view of the corner protector of FIG. 1 according to one example of the disclosure.
Figure 4:
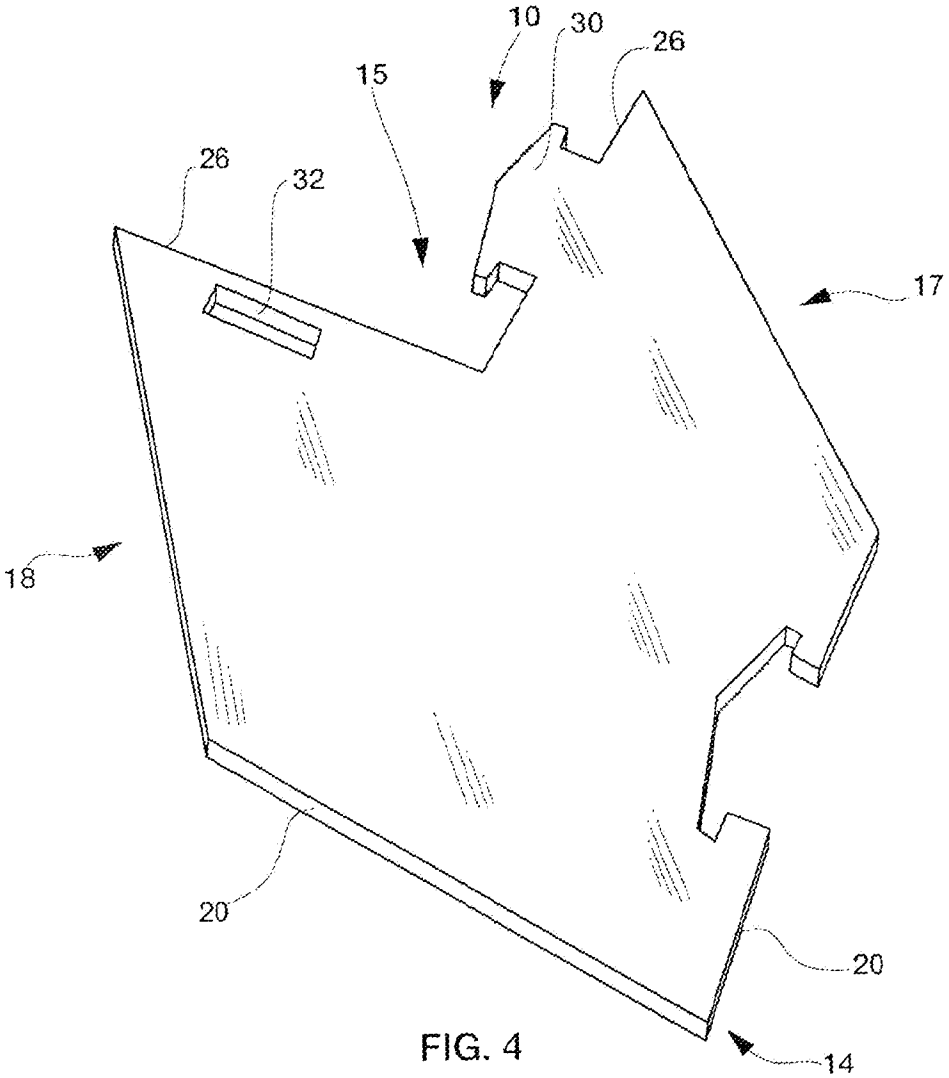
FIG. 4 is a back view of the corner protector of FIG. 1 according to one example of the disclosure.
Figure 5:
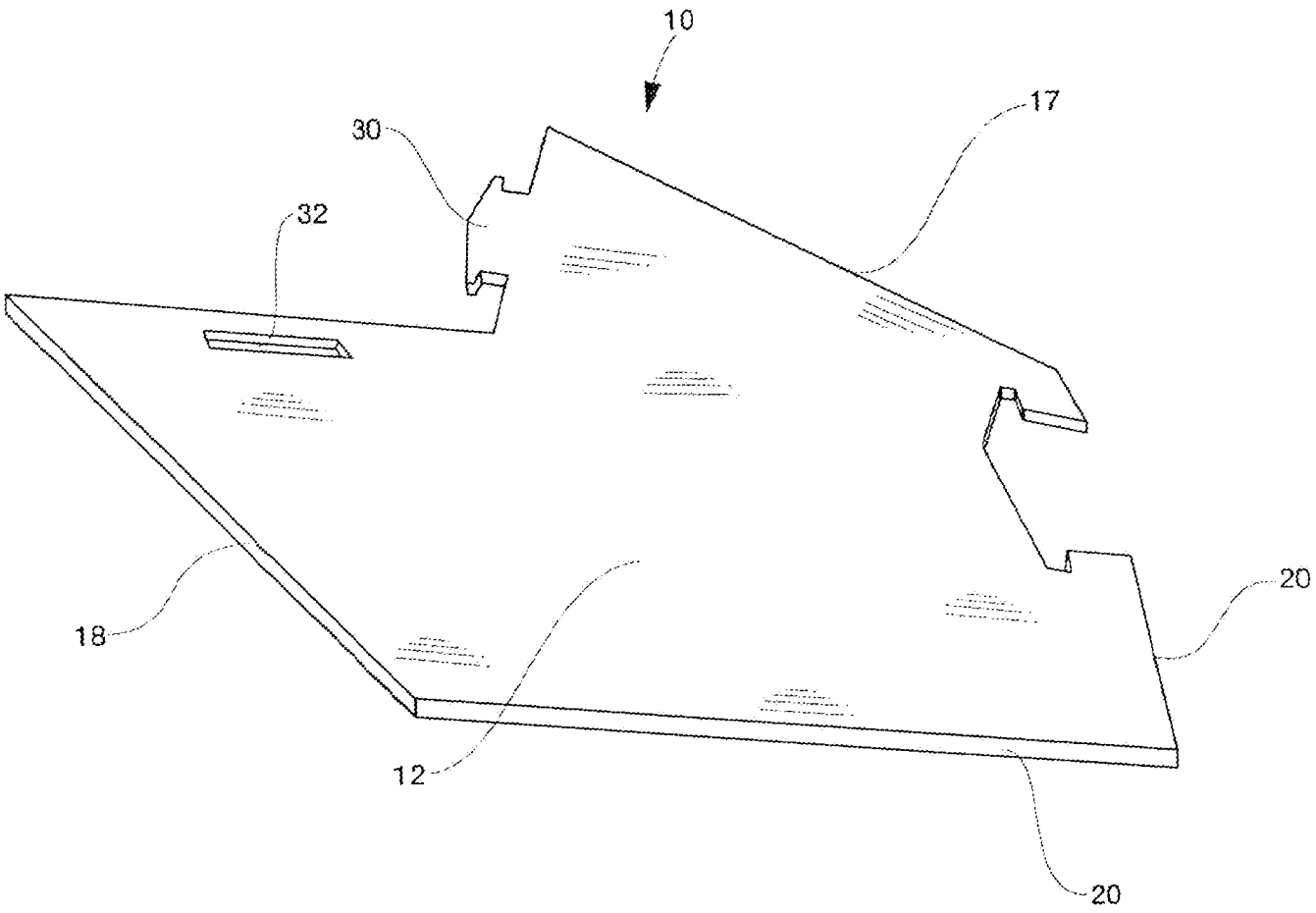
FIG. 5 is a perspective back view of the corner protector of FIG. 4 according to one example of the disclosure.
Figure 6:
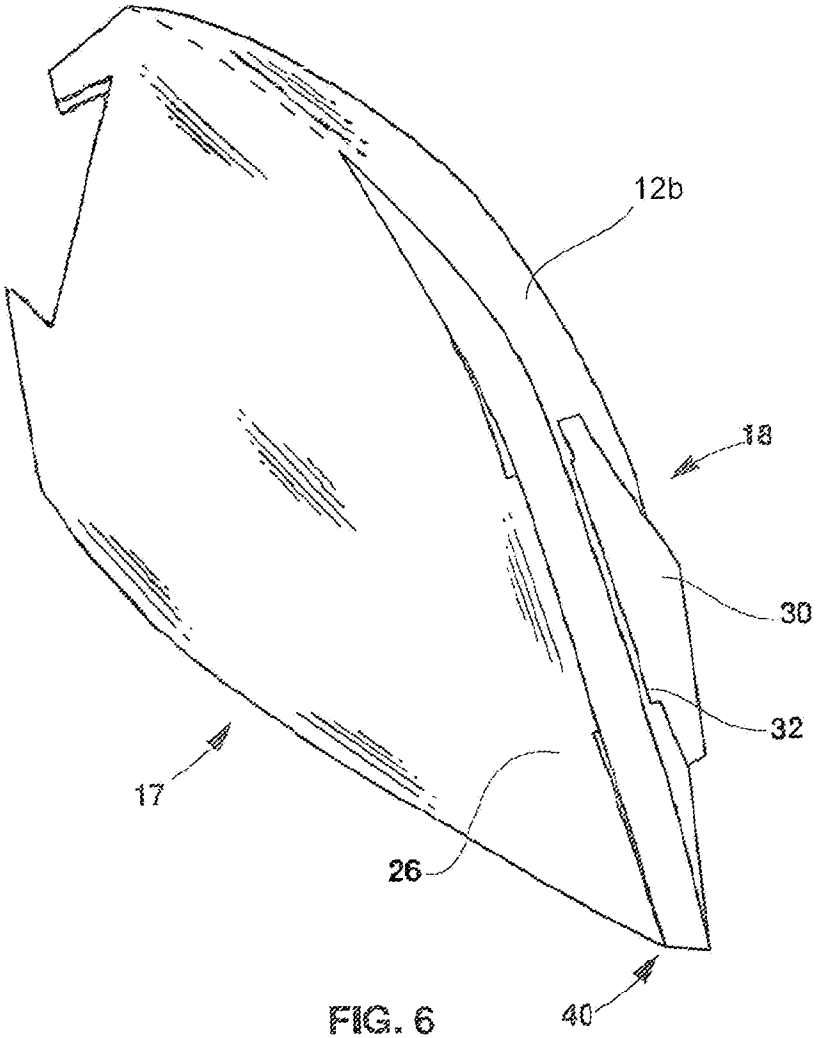
FIG. 6 is a back view of one example of the corner protector of FIG. 2 according to an embodiment of the present disclosure in a second position.

The corner protector may include a first position (an example as seen in FIG. 1) and a second position 40 (an example as seen in FIG. 2). The first position may be a linear sheet position. The first position may be a flat sheet position. The second position may be an assembled position. The second position may be a folded position. In the second position, the corner protector 10 may take on a pyramidal shape. The pyramidal shape may define a space, the space being configured to receive a furniture item. In some examples, the pyramidal shape may include four edges. The edges may include in some examples, two sides 17, 18 and two ends 14, 15 brought toward each other to form a biased position. The attachment projection 30 may include a neck portion 19*a* and a head portion 19*b*. The attachment projection 30 may include a lip 19*c*. The attachment projection 30 may mate with the attachment receptor 32 to secure the corner protector in the second position. In some examples, the body 12 may be a flexible body. The body 12 may be a stretchable body. The body 12 may be a foam body. The foam body may be a polyolefin foam body.

The corner protector 10 may include an adhesive 24 on the body 12. The adhesive 24 may be a strip of adhesive. An adhesive cover, for example a contact release liner, may be included.

In certain instances, the corner protector may, in a second position, take on a folded shape. The folded shape may be a pyramid. This pyramidal shape provides more effective protection of the edges of the furniture. In some examples, the corner protector may include at least 7" sides, and in some cases at least 7.5" sides. The corner protector may also include at least a 3.75' inner height, and in some cases at least a 4" inner height. The pyramidal shape may be a four-edged pyramid including at least 7" to 7.5" sides at the four bases, with a tall height of at least 3.75" to 4". Conventional protectors of this size would take up around 89 cubic inches of shipping space, in comparison to Applicant's inventions where, by way of example, an entire corner protector sheet when shipped flat in a first position, may only consume about 36.125 cubic inches of shipping space. This is an increased shipping capacity over a conventional type protector where in a pallet 36×48" stacked 3" high will hold about 3,048 formed protectors, however, Applicant's flat to folded corner protector system in the same shipping container would hold 5,040, a 165% increase and improvement. This significant savings in freight costs is an important consideration that drives manufacturing cost of goods down for the furniture manufacturer.

Corner protectors 10 may include a strip of adhesive that may be applied prior to arriving at a furniture manufacturer. A suitable adhesive may, by way of example, be a Jowatherm® 245.55 pressure sensitive hot melt adhesive and may include a cover. A suitable cover may, by way of example be a silicone release liner paper, by way of example as provided by Rayven, Inc. This combination is one that allows the corner protector to be held in place in a cost-effective manner, for example, when the assembled corner protector is placed on top of a layer of stretch wrap. With the adhesive layer, furniture manufacturers will have the flexibility to choose to adhere the corner protector onto a layer of stretch film that has been applied to the finished furniture then ship their finished goods, or they can choose to add another layer of stretch film depending on their quality specifications and depending on their internal material cost goals.

In some examples, a system for a corner protector 10 may include a set of stackable linear sheets, wherein each sheet within the set of stackable linear sheets includes, a set of corner protectors 10 arranged in a first position. Each corner protector 10 of the set of corner protectors may include, a body 12, a first end 14 including a shoulder 20, a second end 15 including a cutout 26, a first side 17, and a second side 18. The cutout 26 may include an attachment projection 30 and an attachment receptor 32. In one example, the corner protector system may take on a flat sheet shaping. Once shipped in the flat sheets to the furniture manufacturer, the corner protectors in the system may be separated and alternated into a multi-dimensional second position. The corner protectors 10 are able to rapidly snap from the flat sheet first position into a multi-dimensional second position by way of, in some examples, a mechanical fastening method and/or a hook and receiver manner.

The corner protector 10 body 12 may be made from a foam. In some examples, the body 12 may be a polyolefin foam. The body 12 may have a relative flexibility, a compression set of around 25%, tensile stress of around 58 psi, an elongation of around 25.5%, and/or a tear resistance of 8.4 lb.cu.ft. These overlapping features create a unique corner protector that is able to stretch, and to more readily conform to a significant variation in angles and shapes of furniture corners produced by furniture manufacturers, while also being economical and durable. Impact protection is also achieved, with some examples including a compression strength of between about 3.0 psi to about 12.5 psi (ASTM D3575-93 Suffix D @ 25%/50%) variable with size differentiation. In some examples, the corner protector may include a compression set of between 25%-28% (ASTM D3575-93 Suffix B). The flexibility and durability are often competing factors and the inventions of the present disclosure are an improvement over corrugated or rigid plastic which are both much more limited in one or more of these factors. In this example, the invention overlaps in being able to both be flexible and durable.

A corner protector body 12 may include a density. The density, in some examples, may be in a range of 0.8 lb/cu ft-1.5 lb/cu ft. During the extrusion process, a polyethylene feed stock may be fed into an extruder, for example, a Gloucester Engineering 3.5"-4.5" right hand extruder, that is heated to (200 F—220 F temperature), and then the heated feedstock is pushed through the extruder by the use of a large screw located inside the extruder. The melted polyethylene may then be pushed through the extruder and out through a narrow opening where the polyethylene is then injected with an expanding agent or blowing agent (for example butane or CFC). As the foamed plastic expands with the addition of the blowing agent, the foamed plastic continues beyond the exit of the extruder and then begins to cool. The extruded shape, by way of example, can be produced in a sheet with a thickness range of 0.25"–0.5" and a width of 48"-60." The sheet may then be rolled up and cut to lengths of 150'-300' with an exemplary finished roll product being a 0.25"×60"×300' roll. After extrusion, a foamed plastics fabricator may die cut the rolls to a specific shaped corner protector system as desired using, for example, an Associated Pacific (ABC-60 MODEL) hydraulic kiss cut press. With a steel rule die mounted in the hydraulic press, the polyolefin foam can be run into the machine, then stamped with a specifically designed shape from the rule in the steel rule die. Multiple pieces of the corner protector can be stamped with each hit of the hydraulic die press.

Once the parts have been die cut, the system corner protectors 10 may be formed in multiple copies within one sheet. The corner protects 10 may have a narrow bead of adhesive applied using a hot melt adhesive applicator, for example, by a Nordson Durablue 10 low temperature hot melt glue gun. After the hot melt adhesive is applied, a layer of thin contact release liner like may be placed over the bead of adhesive. One application may be able to apply an adhesive to multiple corner protectors in one application, saving time and cost. The contact paper may prevent the flat corner protectors from adhering to each other when they are placed in stacks, and can rapidly be removed when the furniture manufacturer is ready to apply the corner protector pads to the finished furniture pieces. The flat corner protector pads can be shipped in stacks that optimize the shipment cube size of the inside of a truck from foamed plastic fabricator to the location where the furniture is being manufactured. Once the flat corner pads arrive at the furniture manufacturer, they can be applied to the completed furniture pieces that are ready for shipment.

In other examples, a corner protector 10 may include a body 12 made of a low density or a linear low density polyethylene sheeting. A density may be between 0.919 to 0.924 with a melt index in the range of 0.8 to 2.3. The body 12 may be a mono layer sheet and within the range of 0.00075 mil to 0.008 mil. The body 12 may have a thickness of between 0.001 to 0.0015 with characteristics as indicated in the ranges of some or all parameters as demonstrated below in Table 1:

TABLE 1

| | | | | |
|---|---|---|---|---|
| Tensile | | Low Density(psi) | Linear Low Density(psi) | ASTM D882 |
| | MD | 3250 to 3500 | 5900 to 6200 | |
| | TD | 2450 to 2700 | 4100 to 4800 | |
| Dart Impact | | Low Density (g) | Linear Low Density (g) | ASTM D1709 |
| | | 100 to 110 | 220 to 260 | |
| Elongation | | Low Density (%) | Linear Low Density (%) | ASTM D882 |
| | MD | 350 to 400 | 570 to 650 | |
| | TD | 575 to 700 | 670 to 900 | |
| Tear Resistance | | Low Density (g/mil) | Linear Low Density(g/mil) | ASTM D1922 |
| | MD | 375 | 300 to 570 | |
| | TD | 300 | 700 to 1000 | |
| Temperature Limits | | −25 Degrees Celsius up to 108 degrees Celsius | | |

In other embodiments, the disclosure includes a furniture corner protector kit. Still in other embodiments methods for protecting furniture corners by way of any of the embodiments described herein are considered within the scope of this disclosure.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

We claim:

1. A furniture corner protector for protecting a corner of a furniture item, the furniture corner protector comprising:

a body including:

a first main surface;

a second main surface opposite to the first main surface;

a first side;

a second side opposite to the first side;

a first end, the first end having a first shoulder and a second shoulder; and a second end opposite to the first end, the second end defining a cutout recessed inwardly toward the first end, the second end having a first cutout side and a second cutout side, wherein the first shoulder extends from the first side outwardly away from the second end, the second shoulder extends from the second side outwardly away from the second end, the first shoulder and the second shoulder meet each other and form an angle therebetween, wherein the first cutout side extends from the first side inwardly toward the first end, the second cutout side extends from the second side inwardly toward the first end, the first cutout side and the second cutout side meet each other and form an angle therebetween, wherein the second end includes an attachment projection and an attachment receptor, the attachment projection extends from the first cutout side into the cutout, the attachment receptor is a through slot within the body and spaced apart from the second cutout side and the cutout, the attachment receptor is open on the first main surface and the second main surface, wherein the body is in a flat sheet position, wherein the body is configured to be folded from the flat sheet position into a folded position for protecting the corner of the furniture item, wherein, in the folded position, the attachment projection is configured to extend through the first main surface, the attachment receptor, and the second main surface to secure the attachment projection within the attachment receptor, and wherein, in the folded position, the body forms a pyramidal shape, the pyramidal shape includes four sides defining a space, the space being configured to receive the corner of the furniture item.

2. The furniture corner protector of claim 1 wherein the attachment projection includes a head portion and a neck portion, and wherein the neck portion extends from the first cutout side and connects the head portion to the first cutout side.

3. The furniture corner protector of claim 2 wherein the head portion defines a lip, and wherein, in the folded position, the attachment projection is configured to extend through the attachment receptor such that the lip is configured to mate with the second main surface to secure the attachment projection within the attachment receptor.

4. The furniture corner protector of claim 3 wherein, in the folded position, the neck portion is configured to be received within the attachment receptor and the head portion is configured to be positioned outside of the attachment receptor.

5. The furniture corner protector of claim 1 further comprising an adhesive.

6. The furniture corner protector of claim 5 wherein the adhesive is an adhesive strip.

7. The furniture corner protector of claim 6 wherein the adhesive strip is positioned on the first main surface for attaching the body to the corner of the furniture item when the body is in the folded position.

8. The furniture corner protector of claim 1 wherein the body is flexible.

9. The furniture corner protector of claim 8 wherein the body is stretchable.

10. The furniture corner protector of claim 9 wherein the body is a foam body.

11. The furniture corner protector of claim 10 wherein the foam body is a polyolefin foam body.

12. The furniture corner protector of claim 8 wherein the body has a compression set of between about 20% to about 30%.

13. The furniture corner protector of claim 12 wherein the body has a tensile strength of between about 50 psi to about 65 psi.

14. The furniture corner protector of claim 13 wherein the body has a tear strength of between 8 lb.cu.ft to about 9 lb.cu.ft.

15. The furniture corner protector of claim 14 wherein the body has an elongation of about 20% to about 30%.

* * * * *